US005979721A

United States Patent [19]

Curtis

[11] Patent Number: 5,979,721

[45] Date of Patent: Nov. 9, 1999

[54] GARMENT HANGER

[76] Inventor: Jennifer Alexandra Curtis, 9506 Arnon Chapel Rd., Great Falls, Va. 22066

[21] Appl. No.: 09/122,719

[22] Filed: Jul. 27, 1998

[51] Int. Cl.[6] ..... A47G 25/80

[52] U.S. Cl. ..... 223/94; 223/89

[58] Field of Search ..... 223/85, 89, 94, 223/92, 88

[56] References Cited

U.S. PATENT DOCUMENTS

| | | | |
|---|---|---|---|
| D. 349,410 | 8/1994 | Morales-Rivera . | |
| D. 355,771 | 2/1995 | Adams . | |
| 2,653,739 | 9/1953 | Zenk | 223/94 |
| 2,906,442 | 9/1959 | McNutt | 223/94 |
| 4,948,019 | 8/1990 | Rodum | 223/89 |
| 5,383,584 | 1/1995 | Adams . | |
| 5,397,037 | 3/1995 | Ozawa . | |
| 5,480,076 | 1/1996 | Siegel et al. | 223/94 |
| 5,645,200 | 7/1997 | McDowell et al. | 223/94 |

FOREIGN PATENT DOCUMENTS

| | | | |
|---|---|---|---|
| 811150 | 8/1951 | Germany | 223/89 |

*Primary Examiner*—Bibhu Mohanty
*Attorney, Agent, or Firm*—Whitham, Curtis & Whitham

[57] ABSTRACT

A garment hanger having downwardly foldable, pivoted arms uses a spring between the pivoted arms which is compressed when the pivoted arms are in an operative position and a preferably slidable switch/control latch to control off-axis movement of a central portion of the spring to positively control movement of the pivoted arms between an operative position and a folded position and vice-versa. A hollow lower portion of the central portion of the garment hanger provides a shroud which covers all moving parts to improve ease of use and to prevent damage to garments and, if resilient, provides ease of assembly. The relatively few moving parts cooperate without closely fitting or critical dimensions (thus being unaffected by wear on the relatively few bearing surfaces). The functionality of the garment hanger is improved by resiliently conforming to a garment placed thereon and can be shaped, at will, for aesthetic purposes or to simulate the shape of the human shoulders or upper torso. The movement of the pivoted arms between folded and operative positions is easily controlled by manipulation of the sliding switch/control latch with one hand, particularly for insertion into garments having neck apertures of limited dimensions.

10 Claims, 1 Drawing Sheet

GARMENT HANGER

BACKGROUND OF THE INVENTION

1. Field of the Invention

The present invention generally relates to devices by which garments can be hung for storage and, more particularly, to garment hangers which can be folded or collapsed for storage, packing, or insertion into or removal from a garment.

2. Description of the Prior Art

Many garments intended for wear on the human torso have often presented problems of storage when not in use. Outside China and some other countries of Asia (where such garments were traditionally designed to be folded into a flat shape for storage in boxes or cabinets) problems of storage arise from the fact that such garments are cut from patterns of cloth and fabricated in a manner which can generally follow the compound curves of the human shoulders and upper torso. Accordingly, devices (commonly known as clothes hangers) for hanging garments from a fixed structure such as a hook or horizontal rod have been developed which, to a greater or lesser degree follow the shape of the human shoulders to avoid excessive distortion or wrinkling of a garment during storage.

However, to provide such a function by simulation of the shape of the human shoulders, such garment hangers have been necessarily of dimensions which are inconveniently large or bulky and generally of rigid form, particularly when made from light-weight materials such as wire. Therefore, the hangers themselves are difficult and inconvenient to store and efforts to reduce weight and bulk generally result in structures which can become tangled with each other and/or cause damage to the garments stored thereon.

Further, to remove the garment from a garment hanger, it is generally necessary to remove the garment hanger from the fixed hook or rod structure, separately remove the garment from the hanger and to replace the garment hanger on the fixed hook or rod. These actions generally require both hands to be used and may be inconvenient and somewhat time-consuming.

An additional difficulty is presented by the fact that many garments in current styles have a neck opening of limited size or which may even require the neck opening to be stretched over the wearer's head when donning or removing the garment. Rigid garment hangers usually must be inserted from the bottom (e.g. waist or lower hem) of such garments which is particularly inconvenient, particularly for one-piece dresses and the like.

Folding garment hangers are known in which the folding function is intended to facilitate storage or insertion into a garment. However, since weight and bulk of the garment hanger is of concern, early designs provided arms which folded upward from an operative position toward an upper portion of the garment hanger, generally in the form of a hook or other arrangement for supporting the garment hanger, which engaged a fixed hook or rod structure, alluded to above. Such an arrangement provided for the arms to pivot downward into an operative position against rigid stops in the garment hanger structure to more reliably support the weight of the garment. However, this feature also complicated the process of removing the garment hanger from the garment as well as placement of the garment thereon and increased the risk of damage to the garment since folds of cloth could become pinched between portions of the hanger structure, including the stops, and snagging of the garment by the arms of the garment hanger. It can readily be appreciated that for removal of a garment from such a garment hanger, that any snagging of the garment on the arms of the garment hanger tends to increase the dimensions of the garment hanger.

Garment hangers in which the arms fold downwardly from an operative position have presented the problem of reliable support of the weight of the garment which has heretofore required trade-offs in regard to the inconvenience of placing the arms of the garment hanger in an operative position after the garment hanger is inserted into the garment. Known designs of this type also provide rigidity once the garment hanger is adjusted into an operative form with the arms extended and requires actions similar to those discussed above in connection with rigid hangers (and usually requiring use of both hands) for removing the hanger from the garment. For example, U.S. Pat. No. 5,383,584 and U.S. Design Pat. No. Des. 355,771 to Adams have a hinged frame which latches into an operative configuration. While the latch can be released with one hand, allowing the arms to fold downward, the arms must be raised manually to an operative and latched position by gripping them with both hands through the fabric of the garment which is especially difficult if the garment is damp or wet. Failure of the latch or accidental disengagement thereof will also render the hanger apparatus inoperative and allow the garment to fall therefrom.

Likewise, U.S. Pat. No. 5,397,037 to Ozawa requires both manual raising of the arms to an operative position simultaneously with both hands and, to remove the hanger from the garment, the pressing of a hook portion toward the body of the hanger to release a detent to allow the arms to again be folded downwardly. The Ozawa design also requires a relatively large plurality of intricate and close-fitting, interacting parts which are subject to wear in order to reconcile the downward folding arm structure with relatively secure holding of the garment; the latter tending to diminish greatly with wear of the parts, particularly the detent structure on which the design relies. The many moving parts which engage each other closely with sliding motions are also particularly likely to snag or otherwise engage the fabric of the garment (particularly if the fabric is thin) and thus to damage the garment, malfunction during insertion into or removal from the garment and to require a protracted and complicated process to disengage the hanger from the garment during which damage the likelihood of damage to the garment is greatly increased.

Horizontally folding hangers are also known, such as U.S. Design Pat. No. Des. 349,410 to Morales-Rivera. However, horizontally folding garment hangers are usually intended only to facilitate storage of the hanger and are generally awkward to fold for this purpose and/or less than optimally secure for the hanging of garments. They are especially awkward to unfold to an operative configuration after insertion into a garment since the unfolding operation, in its intermediate positions necessarily involves a three-dimensional volume of substantial dimensions (within the garment) rather than motion substantially in a plane. Horizontal forces applied to a garment hanging therefrom (as is a common action when a person is looking to make a choice among garments hung in a closet or cabinet) may cause sudden folding of the hanger to occur and disengagement of the garment from the hanger.

Additionally, in regard to known folding garment hangers, the folding function thereof often precludes formation of the arm portions or the overall hanger into a shape which optimally supports the shape of the garment or which is aesthetically pleasing, itself. For example, the patents to Adams and Ozawa, discussed above, are constrained to a utilitarian, substantially planar shape which does not simulate the shape (e.g. in front-to-back width) of the human shoulders and a fixed slope which may or may not closely match the shape of the corresponding portions of the garment. These concerns are important for expensive garments which are fabricated or tailored to closely match the shoulder contours of a wearer or which have a small neck aperture. In the latter case, arms which are too nearly horizontal in an operative position may stretch portions of the garment at the shoulder portions of the garment near the arm apertures/sleeves while too great a slope tends to stretch the neck aperture of the garment.

SUMMARY OF THE INVENTION

It is therefore an object of the present invention to provide a garment hanger having arms which fold downwardly from an operative position which will securely support a garment but which can be removed from the garment in several ways by actions requiring only one hand.

It is another object of the invention to provide a garment hanger by which the arms which fold downwardly from an operative position can be raised to the operative position after insertion into a garment without grasping the foldable arms through the garment fabric and which can be accomplished with one hand.

It is a further object of the invention to provide a foldable garment hanger which can be constructed simply and inexpensively with few parts having relatively large dimensional tolerances and which are not subject to significant wear during use which affects the functionality of the garment hanger.

It is yet another object of the invention to provide a foldable garment hanger which greatly diminishes likelihood of damage to a garment during placement of the arms into a folded or operative position.

It is a yet further object of the invention to provide a folding garment hanger which can be fabricated in and aesthetically pleasing shape and/or adequately conform to the shape of a garment at the shoulder portions thereof.

In order to accomplish these and other objects of the invention, a garment hanger is provided including two pivoted arms extending from a central portion of said garment hanger having a hook or the like for supporting the garment hanger and an arrangement for pivotably engaging the pivoted arms, a resilient spring extending between seats on respective portions of the pivoted arms and extending therebetween to control movement of said pivoted arms, and an arrangement for controlling off-axis movement of a central portion of the spring member between said seats. A hollow lower portion of the central portion of the garment hanger covers all moving parts and provides for ease of assembly. The moving parts are not closely fitted and do not have critical dimensions and, hence, are tolerant of any wear which may occur.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
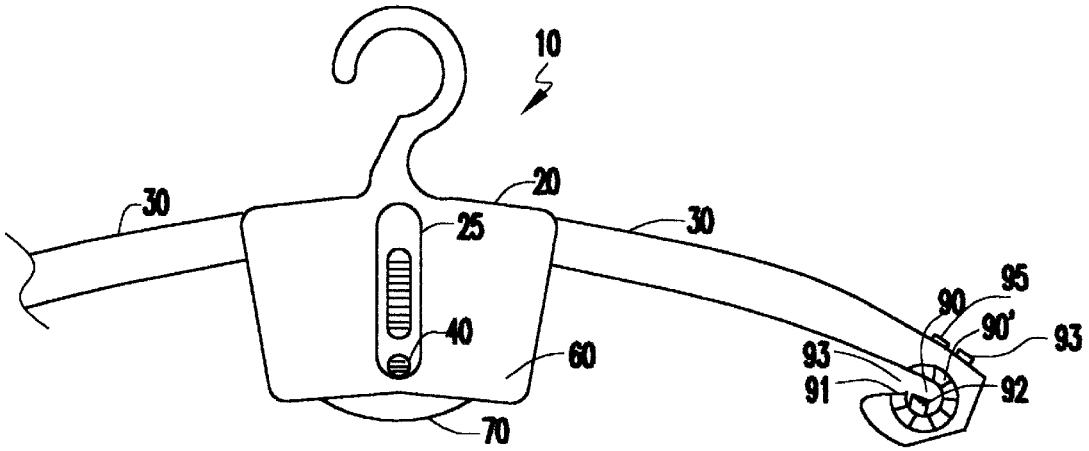
FIG. 1 is a side view of a garment hanger in accordance with the invention.

Referring now to the drawings, and more particularly to FIG. 1, there is shown an overall side/front view of a garment hanger 10 in accordance with the invention. A preferred form of the invention has only five parts which support the meritorious function thereof, four of which are visible in FIG. 1. Three of the four parts, namely the central portion 20 and arms 30 can be freely shaped for aesthetic purposes or to more accurately accommodate the shape of a garment to be hung thereon. Further, other than functional features of the switch 40 which will be discussed in detail below, slide switch or control latch 40 can generally be freely shaped, as well. The fifth part, spring 50, shown in FIGS. 2, 3, 5 and 6, is preferably a coil spring or other flexible and axially compressible part, such as a rubber or resilient plastic tube or cylinder but one or more springs of other forms may be suitable, as will be apparent from the following discussion of the invention.

Specifically, the central or hook portion 20 of garment hanger 10 has a hollow lower portion 60 which may be partially covered with an integrally formed or detachable cover portion 70. The central portion also includes structures 80, the form of which (e.g. molded bosses, cylindrical pins, etc.) is not critical to the practice of the invention, to provide pivot points for the folding arms 30 which should also include a feature mating therewith to complete a pivot joint or hinge.

The opposite, outer ends of the arms 30 are preferably but optionally equipped with a cut-out 90 for holding straps or hanging loops of dresses and the like and/or resilient pads 95 to prevent or reduce slippage of the garment over the ends of the arms. Cut-out 90 may also be lined with a rotatable insert/liner 91 in the form of a sector of an annulus which can be rotated in the directions indicated by double arrow 92 to selectively close or open gap 93 to provide increased security of retention of garment straps or loops. Cut-outs 90 and insert/liner 91 are preferably fit together with a mating groove and ridge of a form not at all critical to the function of these parts. These features, while being preferred, are entirely optional and do not, in any way, affect the principles of operation of the invention but serve to extend the utility of the invention to the storage of additional types and styles of garments.

Figure 4:
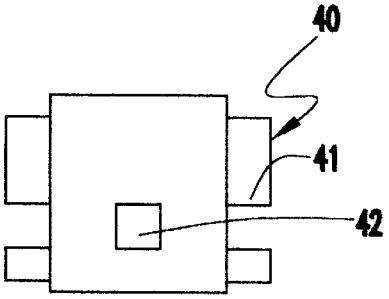
FIG. 4 is a plan view of slidable switch/control member in accordance with the invention.

Central portion 20 also includes a vertical slot 25 which slidably engages a switch/control member 40, having ears 41 (FIG. 4) which ride in slot 25 and may be arranged to protrude therefrom. Additionally or alternatively, switch/control member 40 can be shaped and arranged to protrude from the top and bottom of central portion 20. As shown in FIG. 4, switch 40 also includes and aperture 42 through which spring 50 extends. Of course, other structures could be used to attach to and control whatever form of spring is used in accordance with the principles of the invention. In the preferred form of the invention, aperture 42 allows the spring 50 to move freely in an axial direction through aperture 42 but controls lateral (off-axis) movement of a central portion of the spring 50. Slot 25 is preferably symmetrically arranged centrally of the central portion 20 and between the foldable arms 30. In a preferred form of the invention, central portion 20 is formed of a material sufficiently resilient to allow deformation sufficient to insert slidable switch 40 therein to engage slots 25 which thereafter retain it. It is preferred, but not necessary, that the arms be accommodated onto pivot structure in much the same manner by flexure of the hollow lower portion 60 of central portion 20. Once assembly is completed, lower cover 70 can be configured (in a manner evident to those skilled in the art but not at all important to the principles and practice of the invention) to prevent similar flexure and retain the arms 30, slide switch 40 and spring 50 in an operative relationship.

Figure 5:
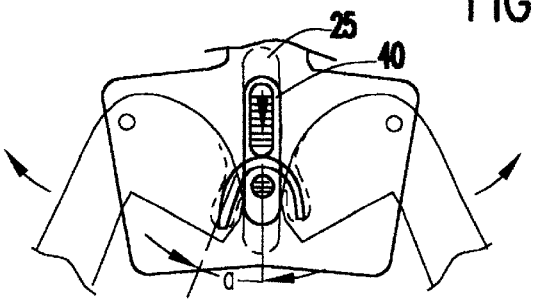
FIG. 5 is an enlarged partially cut-away side view of a central portion of the garment hanger of FIG. 1, showing the arms in an intermediate position between a folded position and an operative position to facilitate an understanding of the principles of the invention.

The basic principles of operation of the invention will now be described in connection with FIGS. 2, 3 and 5. It should be clearly understood that the dimensions shown in these Figures are exemplary and chosen for clarity of illustration and to permit a rapid understanding of the principles of the invention. However, the shapes and relative dimensions may be readily adapted using basic geometric principles of levers to adjust forces required for operation of the invention relative to garment weights which must be supported. It is contemplated as being desirable that different geometries be provided which are scaled to garment weights but which may be operated by comparable forces. The garment hangers could then be color-coded or the like to correspond to garment weights for convenience of appropriate selection and use in accordance with garment weight.

Figure 2:
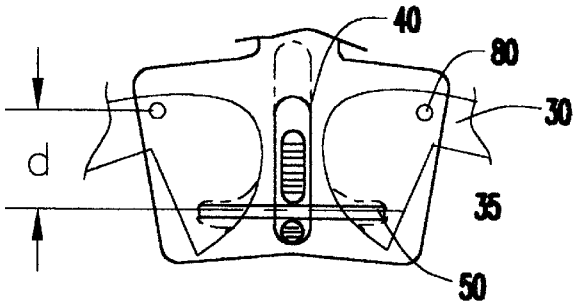
FIG. 2 is an enlarged partially cut-away side view of a central portion of the garment hanger of FIG. 1, showing the arms in a folded position.

Referring now to FIG. 2, a partially cut-away view is shown of the central portion of a garment hanger in accordance with the invention.

Only the inner ends of arms 30 are shown in the extended, operative (as opposed to folded) position. Slide switch 40 is shown in the lower position corresponding to the position thereof shown in FIG. 1.

Inner ends of arms 30 include partially cylindrical, partially conical or substantially exponential recesses 35 to form seats for the respective ends of spring 50. The internal shape of these recesses is not particularly critical to the practice of the invention but the generally conical shape should generally be provided in sufficient degree to prevent binding with spring 50 during operation. Cylindrical portions can be provided in deeper regions of the recess which may be of assistance in controlling the positions of the arms as will be more evident in view of the following discussion, particularly in regard to FIGS. 3 and 5.

It should be noted that in this position of the slide switch 40, spring 50 is straight and compressed between the bottoms of recesses 35, It is preferred that spring 50 be a metallic helical spring which is almost fully compressed in this state. If this highly compressed state is provided, the weight of the garment can cause only slight downward movement of the pivoted arms before metal-on metal contact is achieved between adjacent helical spring coils at full compression of the spring 50; thereby providing a high degree of security for retaining the garment on the garment hanger while allowing a slight resiliency in the position of the arms 30 to conform to the shape of the garment without stretching the garment as described above.

Alternatively, the spring can be less fully compressed which would allow the garment to be removed from the hanger by simply pulling downwardly thereon, allowing the arms to pivot downwardly against the force of the spring 50. In this case, security of the engagement of the hanger and garment is achieved by leverage and the spring constant of spring 50. That is, the length of the cantilevered portion of arm 30 and the distance d can usually be kept to a relatively low ratio of about 4:1 or less. For garments of relatively low weight a spring 50 having a relatively low spring constant can be used, especially when it is considered that the weight of the garment will be distributed over the length of the arms 30 and that downward force of the arms will cause compression of spring 50 from both ends, multiplying the upward force on arms 30 with downward motion thereof while reducing the mechanical advantage of the pivoted arms against spring 50 since downward motion of arms 20 effectively transfer the load inward along the arms 30 toward central portion 20, thus reaching a stable equilibrium state in which the angle of the arms 30 accurately conforms to the garment shape.

Figure 3:
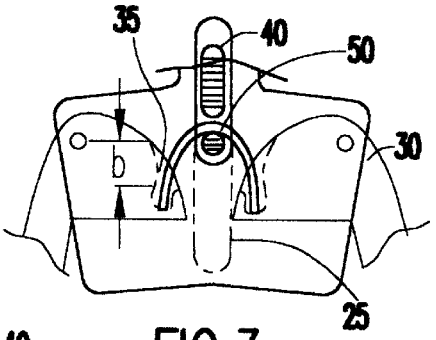
FIG. 3 is an enlarged partially cut-away side view of a central portion of the garment hanger of FIG. 1, showing the arms in an operative position.

FIG. 3 generally corresponds to FIG. 2 but with slide switch 40 moved to the upper extreme position and arms 30 in the downwardly moved, folded position. It can be appreciated that movement of switch 40 has forced the central portion of spring 50 to move laterally into a substantially uncompressed inverted "U" shape. The "U" shape of spring 50, thus achieved, together with the seating of spring ends in recesses 35 positively applies a folding force to arms 30 and tends to retain them in a stable, folded position. This stable, folded configuration provides increased ease of insertion into a garment having a neck aperture of limited size. The stability of this configuration also assists in avoiding tangling with other hangers and packing and/or storage in limited spaces.

Figure 6:
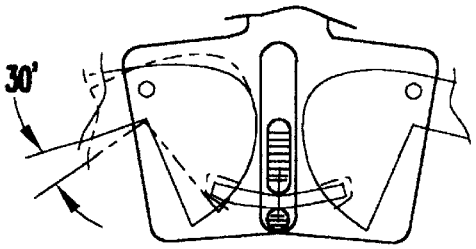
FIG. 6 is an enlarged partially cut-away side view of a central portion of the garment hanger of FIG. 1, showing the arms in an operative position in accordance with an optional perfecting feature of the invention providing an enhanced latching function when the arms are in an operative position.

It should be noted also that this configuration of the garment hanger in accordance with the invention is achieved simply by movement of switch 40 which can be easily achieved with one hand with relatively low force. That is, once lateral motion of the central portion of spring 50 is initiated (e.g. more than the diameter of the spring off-axis), spring 50 assists in upward movement of the switch 40, allowing the garment to drop freely from the hanger. This is in sharp contrast with the position of FIG. 2, particularly when spring 50 is more tightly compressed and the straightened position is quite stable. Stability of the position shown in FIG. 2 can also be increased with a simple detent of any form against switch 40 to releasably maintain the straight, compressed configuration of spring 50. Alternatively, as a perfecting feature of the invention, slot 25 can be extended slightly in the downward direction as shown in FIG. 6 to allow the compression of spring 50 to establish a slightly "over-center" configuration which will also stabilize the slide switch **40*b* in the lower extreme position. This optional feature of the invention may be useful in counteracting any bending or shape memory exhibited by spring 50 which may be occasioned by the shape spring 50 assumes in the state shown in FIG. 3. In any event, it should be understood that lateral movement of the central portion of a compressed spring can be achieved to the configuration shown in FIG. 3 with relatively little force, particularly as compared with the axial compression of the spring. Therefore, the configuration of spring 50 can be easily controlled with relatively little force applied to slide switch 40** which can be accomplished easily with one hand.

This advantage of the present invention obtains for either direction of motion of slide switch 40 and corresponding to either insertion of the hanger into the garment or removal of the garment from the hanger. This fact can be, perhaps, more readily understood by considering FIG. 5 which represents and intermediate position of slide switch 40 and arms 30 between the positions shown in FIGS. 2 and 3. Assuming slide switch 40 is being moved downwardly to extend arms 30 from the folded position of FIG. 3 to the operative position of FIG. 2, initial movement of switch 40 will principally compress both ends of spring 50. The required force per unit of motion will thus be, at most, twice the spring constant (reduced somewhat by the ability to bow the central portion of the spring 50 outward and relieved by movement of the arms 30 toward their operative position). However, the actual force to be required to cause movement of slide switch 40 as applied by the hand is relatively low since spring 50 is relatively uncompressed in the configuration of FIG. 3.

As motion of the slide switch 40 progresses, the required applied force is relieved, as alluded to above, by motion of the arms which is positively controlled both by the compression of the ends of spring 50 and the angle of the spring ends in apertures 35 as arm movement progresses. Further, as arm movement progresses, as shown in FIG. 5, angle a increases and the force required to move slide switch 40 obtains mechanical advantage therefrom since incremental movement of slide switch 40 causes incrementally less compression of the spring ends as movement of the slide switch progresses and angle a increases. Therefore, movement of slide switch 40 is relatively smooth and requires relatively constant force over its full range of travel assuming some movement of arms 30 toward the operative position is permitted. Smoothness of movement and evenness of applied force can be adjusted somewhat by alteration of the pitch of helical windings along the length of the spring in combination with the geometry employed in any specific embodiment fabricated in accordance with the principles of the invention.

It should be noted in this latter regard that both the compression of the spring ends and the natural cylindrical shape of spring 50 tend to urge arms 30 upward toward the operative position once downward movement of slide switch 40 is commenced from the extreme position of FIG. 3. That is, the configuration of FIG. 3 is stable because dimension b is relatively small and the spring 50 is substantially uncompressed while the spring in a "U" shape is at a mechanical disadvantage. Movement of the arms toward the operative position will cause tension in spring 50 (if the ends are seated firmly in recesses 35) which will tend to counteract the lever over dimension b. However, after the onset of compression of spring 50 by movement of slide switch 40, the arms are positively urged toward their operative position with mechanical advantage of movement of switch 40 increasing with distance of movement accompanied by arm movement. Therefore, after inserting the garment hanger 10 in accordance with the invention into a garment and starting movement on the slide switch 40, the arms are automatically urged upward with increasing force and need not be raised manually by grasping the arms through the fabric of the garment, as in prior folding garment hangers. At most, it is sufficient to slightly shake the garment hanger and garment as the process proceeds which, again, can be done with one hand. Shaping of the arms in an aesthetic or shoulder shape simulating manner as enabled by the present invention can also beneficially reduce friction with the garment during the process of inserting the garment hanger into a garment.

Conversely, it should be appreciated that during upward movement of the slide switch 40, the arms 30 are positively urged downwardly by the angle, a, developed by movement of the central portion of the spring off its axis. Therefore, it can be seen, in sharp contrast with prior designs of folding garment hangers, that the position of the arms is substantially controlled entirely by slide switch 40 while limiting any force applied to the garment to the relatively weak force applied by the spring 50 seeking to assume a cylindrical shape over respective portions thereof. Such a weak force limits the possibility of binding with the fabric of the garment and, together with the protection of the few moving parts by the hollow lower portion 60 of central portion 20, virtually eliminated the possibility of inadvertent damage to the garment by the garment hanger in accordance with the invention. In addition, the relative motion of parts at the edges of central portion 20 exposes rather than occludes surfaces of the folding arms, further tending to avoid pinching of the fabric during arm extension. Similarly, during folding of the arms, the garment fabric will generally be in tension from its own weight in regions where the arm surface is occluded by the folding action, similarly tending to avoid pinching or snagging of the fabric. No similar control of folding arm motion, protection of garment fabric from moving parts stability of both operative and folded configurations or ease and convenience of operation is provided by prior designs of folding garment hangers.

It should also be noted that the only bearing surfaces of the mechanism of the garment hanger in accordance with the invention are the (fully covered) pivot hinges of the folding arms, slide switch ears 41 against slot 25 (which is not generally covered with fabric and which, during operation will have the user's hand naturally interposed between any fabric and the slide switch and slot) and the contact between spring 50 and aperture 42 in slide switch 40, none of which present the possibility of wear which could, in any way, affect proper functioning of the garment hanger in accordance with the invention. None of the parts of the garment hanger in accordance with the invention are or need be of critical dimensions or closely fitted together for proper operation.

From the foregoing, it is clearly seen that the garment hanger in accordance with the invention provides a folding garment hanger which securely supports a garment while allowing removal of the garment from the hanger in several convenient ways, that does not require grasping and manipulating the foldable arms through the fabric of the garment after insertion through an aperture of limited size, has relatively few, inexpensively fabricated parts of non-critical dimensions and which are not subject to wear that affects operability, which reduces likelihood of damage to garments and which can be fabricated in an aesthetically pleasing shape and/of a shape which conforms to the shape of a garment. Further, the garment hanger in accordance with the invention provides a significant and useful degree of resilient accommodation of the shape of a garment stored thereon and can be folded for storage into a limited space.

While the invention has been described in terms of a single preferred embodiment, those skilled in the art will recognize that the invention can be practiced with modification within the spirit and scope of the appended claims.

Having thus described my invention, what I claim as new and desire to secure by Letters Patent is as follows:

1. A garment hanger including two pivoted arms extending from a central portion of said garment hanger having a means for supporting the garment hanger and means for pivotably engaging said pivoted arms, a resilient spring means having an axis and extending between seats on respective portions of said pivoted arms and extending therebetween and controlling movement of said pivoted arms, and means movable relative to said central portion of said garment hanger for controlling off-axis movement of a central portion of said spring means between said seats whereby movement of said pivoted arms is controlled.

2. A garment hanger as recited in claim 1, wherein said central portion of said garment hanger further includes a hollow lower portion enclosing inner ends of said pivoted arms, said spring means and said means for controlling off-axis movement of a central portion of said spring means.

3. A garment hanger as recited in claim 1, wherein said means for controlling off-axis movement of said central portion of said spring means is slidably engaged with said central portion of said garment hanger.

4. A garment hanger as recited in claim 1, wherein said means for controlling off-axis movement of said central portion of said spring means includes an aperture through which said spring means extends.

5. A garment hanger as recited in claim 3, wherein said means for controlling off-axis movement of said central portion of said spring means includes an aperture through which said spring means extends.

6. A garment hanger as recited in claim 1, wherein said spring means is a helical spring.

7. A garment hanger as recited in claim 1, further including a detent means for releasably maintaining said means for controlling off-axis movement of said central portion of said spring means in a desired location.

8. A garment hanger as recited in claim 7, wherein said detent means comprises an over-center configuration of said spring means.

9. A garment hanger as recited in claim 3, further including a detent means for releasably maintaining said means for controlling off-axis movement of said central portion of said spring means in a desired location.

10. A garment hanger as recited in claim 9, wherein said detent means comprises an over-center configuration of said spring means.

* * * * *